US005951133A

United States Patent [19]

Dittberner et al.

[11] Patent Number: 5,951,133

[45] Date of Patent: Sep. 14, 1999

[54] DRAWER HEAD

[76] Inventors: Daniel J. Dittberner, 17458 Tuscany La., Cornelius, N.C. 28031; Kurt P. Rindoks, 619 Lorimer St., P.O. Box 1013, Davidson, N.C. 28036

[21] Appl. No.: 08/927,451

[22] Filed: Sep. 11, 1997

[51] Int. Cl.[6] ..... A47B 88/00

[52] U.S. Cl. ..... 312/348.4; 312/332.1; 312/400

[58] Field of Search ..... 312/348.4, 332.1, 312/243, 400, 204, 330.1

[56] References Cited

U.S. PATENT DOCUMENTS

| | | | |
|---|---|---|---|
| 3,179,480 | 4/1965 | Brinker | 312/348.4 |
| 3,666,341 | 5/1972 | Little | 312/204 X |
| 3,883,255 | 5/1975 | Little | 312/332.1 X |
| 3,895,733 | 7/1975 | Chambers | 312/330.1 X |
| 5,375,923 | 12/1994 | Hall et al. | 312/348.4 |
| 5,437,503 | 8/1995 | Baker et al. | 312/348.4 X |

*Primary Examiner*—Peter M. Cuomo
*Assistant Examiner*—Stephen Vu

[57] ABSTRACT

A drawer head which is readily removable and replaceable from the front of a conventional drawer body is disclosed. The drawer head generally takes the form of a rectangular cover panel sized to cover the front panel of a drawer body. An arcuate handle extends outwardly along the top of the cover panel for allowing a user to easily grip the drawer head in order to slide the drawer in and out of a cabinet. The drawer head includes an elongated slot extending substantially between the sides of cover panel and being adapted to receive a header flange of a drawer body. To attach the drawer head to a conventional drawer body, the header flange of the drawer body is inserted through the elongated slot so that the header flange supports the drawer head with the drawer head in a contiguous relationship with the front panel of the drawer body. Fasteners are then used to secure the bottom of the drawer head to the drawer body.

30 Claims, 2 Drawing Sheets

DRAWER HEAD

BACKGROUND OF THE INVENTION

This invention relates to file drawers and cabinets and more particularly to an improved drawer head for individual drawer bodies which are slidably mounted in such file drawers, cabinets and the like.

File drawers and cabinets typically include a plurality of slidable drawers or drawer bodies. The drawer bodies typically have a handle for allowing the user to slide the drawer body in and out of the cabinet. Over time, the drawer fronts or drawer heads tend to show signs of wear, such as fading of the exterior finish, scratches, dents, chips, and the like. Conventional drawer fronts or drawer heads which exhibit such signs of wear are unsightly and unprofessional looking in an office environment and require replacement of the entire drawer body. It is also common to replace such file drawers to change the color of the drawer heads to match other cabinets or to match changes in office decor. However, replacement of the entire file drawer just to improve the appearance of, or change the color of, the drawer head can be excessively expensive.

SUMMARY OF THE INVENTION

An important aspect of this invention therefore lies in providing a drawer head assembly which is readily removable and replaceable from the front of a conventional drawer body. The removable drawer head allows for easy replacement of only the drawer head instead of the entire drawer body when the drawer head shows signs of excessive wear or a change of color is desired.

Briefly, the drawer head of this invention comprises a generally rectangular cover panel having a top, bottom, and first and second sides and being sized to cover a front panel of a drawer body. The cover panel includes an arcuate handle extending outwardly from its top edge. To permit the drawer head to be easily secured to a conventional drawer body, the cover panel defines an elongated slot extending substantially between the first and second sides of the cover panel and being adapted to receive a header flange of the conventional drawer body. Preferably, the elongated slot is positioned adjacent to the top of the cover panel and the arcuate handle extends outwardly over the slot to cover it from view. After the header flange is inserted through the elongated slot in the top of the cover panel. fasteners are then used to secure the bottom of the drawer head to the drawer body.

In one embodiment, the drawer head is comprised of a back plate and handle plate which extend in the same plane and a back panel which secures the front plate and handle plate together. Specifically, securement means are provided for securing the bottom of the handle plate to the top edge of the back plate and fastening means are provided for securing a first flange of the front panel to the handle plate. The front panel also includes a second flange which receives the bottom edge of the back plate and holds the back plate so that its top edge is received in the securement means. Preferably, the front panel is curved or dome-shaped to define a chamber over the back plate and a curable foam filler or other suitable filler is disposed in the chamber for locking the back plate, handle plate, and front panel together to form a unitary cover panel. The handle plate also includes an arcuate handle which extends outwardly from the top edge of the handle plate for allowing the user to easily grip the drawer head for slidably moving the entire drawer body within a cabinet.

In use, the drawer head is attached to the front panel of a conventional drawer body by inserting the header flange of the drawer body thorough an elongated slot in the handle plate of the drawer head. The header flange includes a perpendicular shoulder which extends through the elongated slot and supports the drawer head. Fasteners are then used to secure the bottom of the drawer head to the drawer body.

Such a procedure is easily accomplished and allows for the easy removal and replacement of drawer heads from conventional drawer bodies.

Other objects, features, and advantages of the present invention will become apparent from the following description and drawings.

DETAILED DESCRIPTION OF THE PREFERRED EMBODIMENTS

Figure 1:
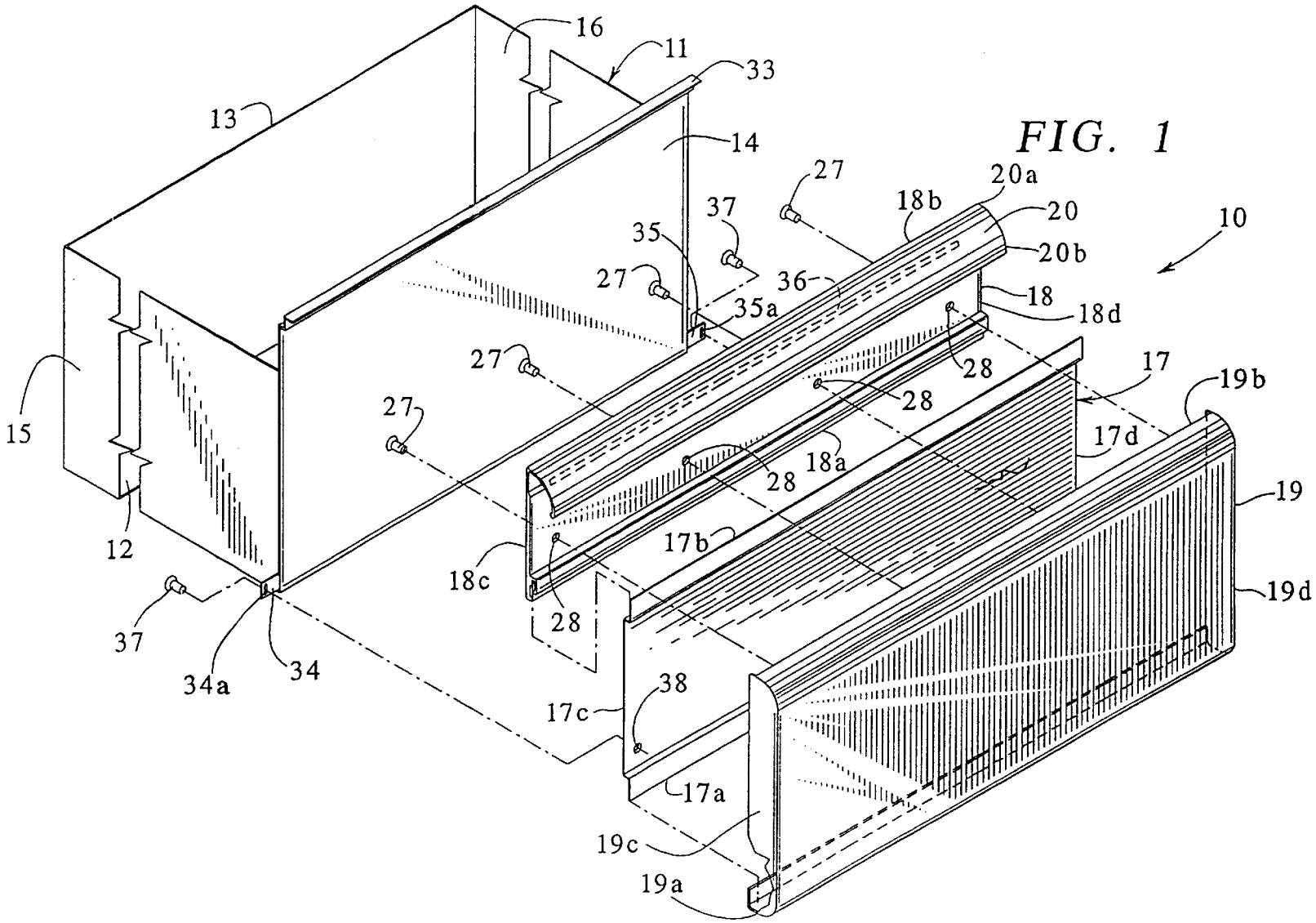
FIG. 1 is an exploded perspective view of the drawer head of this invention shown adjacent to a conventional drawer body.

Referring to the drawings, the numeral 10 generally designates the drawer head of this invention. Drawer head 10 takes the form of a rectangular cover panel sized to be affixed to and cover the front of a conventional drawer body 11. Drawer body 11 is slidably mountable in a conventional file drawer or cabinet (not shown) and includes a bottom 12, perpendicular or vertical back and front panels 13 and 14, and a pair of perpendicular or vertical side panels 15 and 16 which extend between the back and front panels 13 and 14. In the embodiment shown in the drawings, the front panel 14 of drawer body 11 and drawer head 10 generally have a rectangular configuration. However, it will be understood that front panel 14 and drawer head 10 may take the form of a variety of sizes and shapes depending upon the particular application for which they are intended.

In the embodiment shown in the drawings, drawer head 10 includes a back plate 17, a handle plate 18, and a front plate 19. Handle plate 18 includes a bottom edge 18*a*, a top edge 18*b*, and a pair of side edges 18*c* and 18*d*. An arcuate handle 20 extends outwardly from the top edge 18*b* and includes a first edge 20*a* connected to top edge 18*b* and a distal edge 20*b* which projects outwardly over handle plate 18 towards its bottom edge 18*a*. Handle plate 18 may advantageously be made from extruded aluminum, but other suitable materials and manufacturing methods may also be used.

Back plate 17 may be formed from sheet metal or other suitable materials and includes a bottom edge 17*a*, a top edge 17*b*, and a pair of side edges 17*c* and 17*d* which are parallel to side edges 18*c* and 18*d* of handle plate 18. The bottom edge 18*a* of handle plate 18 includes securement means for securing the bottom edge 18*a* to the top edge 17*b* of back plate 17.

Figure 2:
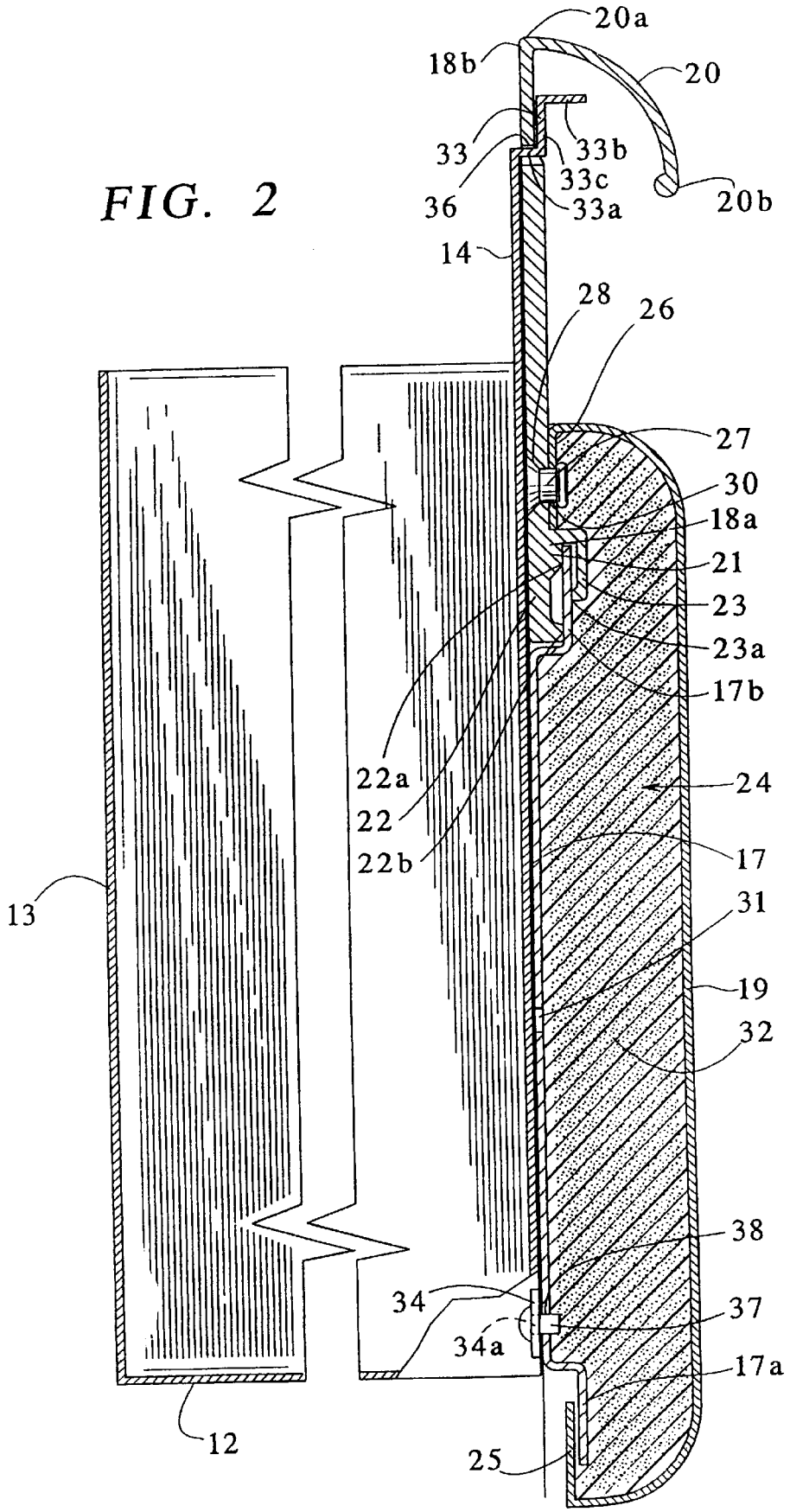
FIG. 2 is a side cross-sectional view of the drawer head of this invention in combination with a conventional drawer body.

Referring to FIG. 2, the securement means may take the form of a U-shaped member 21 which is adapted to receive the top edge 17*b* of back plate 17. In the embodiment shown in the drawings, the top edge 17*b* of back plate 17 is offset from the remainder of the back plate, and the U-shaped member 20 is adapted to receive top edge 17*b* and only allow vertical movement of back plate 17 with respect to handle plate 18. In other words, once top edge 17*b* is inserted into U-shaped member 21, back plate 17 cannot be moved in directions perpendicular to handle plate 18. To achieve such results, the U-shaped member 21 includes first and second depending legs 22 and 23 for securely holding the top edge 17*b* of back plate 17. Leg 22 includes first and second shoulders 22*a* and 22*b* and leg 23 includes a single shoulder 23*a* for engaging top edge 17*b*. The single shoulder 23*a* is positioned generally at a mid-point between shoulders 22*a* and 22*b* so that the three shoulders, in combination, form a three point system for receiving top edge 17*b* and preventing movement of back plate 17 in directions perpendicular to handle plate 18.

The front plate or panel 19 of drawer head 10 includes a bottom edge 19*a*, a top edge 19*b*, and a pair of side edges 19*c* and 19*d* which are parallel to the side edges of back plate 17 and handle plate 18. As shown most clearly in FIG. 2, front plate 19 is curved or dome-shaped and defines an interior chamber 24 between the front plate 19 and back plate 17. The top and bottom edges 19*a* and 19*b* of front plate 19 include, respectively, first and second flanges 25 and 26 which extend parallel to the outermost portion of front plate-19 and to back plate 17.

To assemble back plate 17, handle plate 18, and front plate 19, the bottom edge 17*a* of back plate 17 is inserted inside of flange 25 of front plate 19, and the top edge 17*b* is inserted into U-shaped member 21. In that position, flange 26 abuts against U-shaped member 21 and extends along the bottom edge 18*a* of the handle plate 18. Rivets 27 or other suitable fasteners are then inserted through apertures 28 in handle plate 19 and apertures 30 in flange 26 to secure the handle plate 18 and front plate 19 together. In the alternative, rivets 27 could be replaced with other suitable fastening means including suitable adhesives.

The attachment of the handle plate 18 and front plate 19 also secures back plate 17 in place since the top edge 17*b* of back plate 17 is held by U-shaped member 21 and the bottom edge 17*a* is held by flange 25 of the front plate 19. To complete the assembly, a curable foam filler 32 or other suitable filler is injected through an aperture 31 in back plate 17 to completely fill chamber 24. The foam 32 presses back plate 17 into tight engagement with U-shaped member 21 and flange 25 and then cures or hardens so that all three components are locked in their respective positions. The foam 32 may take the form of any one of a number of well known curable foam fillers. In one embodiment, the foam was a 2-part injected packaging foam sold under the designation Milflex by Sealed Air Corp. of Danbury, Conn. It will also be understood that other suitable fillers may also be used, such as fillers formed from cellular paper products and having adhesive on both sides to bond the assembly together.

Once assembled, drawer head 10 forms a unitary cover panel for completely covering the front panel 14 of the conventional drawer body 11. Conventional drawer body 11 includes a header flange 33 along a top edge of front panel 14. In the embodiment shown in the drawings, header flange 33 includes a shoulder 33*a* and a lead flange 33*b* which extend perpendicularly outward from front panel 14 and an intermediate vertical wall 33*c* which extends between shoulder 33*a* and flange 33*b*. In addition to header flange 33, the front panel 14 of drawer body 11 also includes a pair of tabs 34 and 35 which define apertures 34*a* and 35*a*, respectively.

To permit drawer head 10 to be easily attached to front panel 14, handle plate 18 includes an elongated slot 36 which extends substantially between the first and seconds edges or sides 18*c* and 18*d* of handle plate 18. Preferably, the elongated slot 36 is located adjacent to the top edge 18*b* of handle plate 18, and handle 20 projects outwardly over elongated slot 36 with the distal end 20*b* of handle 20 extending below slot 36 so that handle 20 blocks the elongated slot 36 from view when drawer head 10 is viewed from the front. In use, header flange 33 is inserted through elongated slot 36 until shoulder 33*a* extends through slot 36 and supports the weight of the entire drawer head 10 as shown most clearly in FIG. 2. In such a position, handle plate 18 and back plate 17 extend along the front panel 14 of the drawer body in a contiguous relationship. To complete securement of drawer head 10 to drawer body 11, attachment means in the form of rivets 37 or other suitable fasteners are inserted through the apertures 34*a* and 35*a* in tabs 34 and 35 and into the bottom of the drawer head 10. For example, rivets 37 may be connected to drilled holes 38 in the bottom of the drawer head as shown in FIG. 2.

Drawer head 10 fits easily onto a conventional drawer body and may be easily removed or replaced when desired. To install the drawer head, the header flange 33 on drawer body 11 is simply inserted through elongated slot 36, and then fasteners 37 are used to complete the attachment process. Similarly, drawer head 10 can be easily removed by simply removing fasteners 37 and slipping drawer head 10 off of the drawer body 11. Drawer head 10 represents a significant improvement in this art since it allows for the easy replacement of the drawer head without requiring the complete replacement of a file drawer when a change of the drawer front is desired.

While in the foregoing specification an embodiment of the present invention has been described in considerable detail for purposes of illustration, it will be understood by those skilled in the art that the details given herein may vary considerably within the scope and spirit of the invention.

We claim:

1. A drawer head for the attachment to a drawer body having a drawer flange comprising:

a generally rectangular cover panel having a top, bottom, and first and second sides and being sized to cover a front panel of the drawer body;

an elongated slot having a length extending substantially between said first and said second sides of said cover panel and being adapted to receive a header flange of the drawer body; and an arcuate handle extending substantially between said first and said second sides of said cover panel and extending outwardly from said top of said cover panel toward said bottom of said cover panel with a distal end of said arcuate handle projecting below said elongated slot such that said arcuate handle extends completely over said elongated slot along the entire said length thereof.

2. The drawer head of claim 1 in which said elongated slot is positioned adjacent to said top of said cover panel.

3. The drawer head of claim 1 in which aperture means are positioned adjacent to the bottom of said cover panel for receiving fasteners which secure said cover panel to said drawer body.

4. A drawer head comprising:

back plate having a bottom edge, top edge and first and second sides;

handle plate having a bottom edge secured to the top edge of the back plate, a pair of sides extending generally parallel to the first and second sides of said back plate, and a top edge which includes an arcuate handle which extends outwardly towards the bottom edge of said handle plate, said handle plate further including an elongated slot which extends substantially between said pair of side edges of said handle plate and is adapted to receive a header flange of a drawer body;

securement means for securing said bottom edge of said handle plate to said top edge of said back plate;

a front panel having a bottom edge, a top edge, a pair of opposite sides, and first and second flanges extending from said top edge and said bottom edge, respectively, in directions parallel to said back plate, said first flange being positioned adjacent to said bottom edge of said handle plate and said second flange being positioned over said bottom edge of the back plate; and fastening means for securing said first flange of said front panel to said handle plate.

5. The drawer head of claim 4 in which said front panel and said back plate define a chamber therebetween and said chamber is filled with a filler material.

6. The drawer head of claim 5 in which said filler material comprises a curable foam filler.

7. The drawer head of claim 4 in which said fastening means comprises of a plurality of fasteners inserted through apertures in said handle plate and said first flange of said front panel.

8. The drawer head of claim 4 in which said handle plate is made of extruded aluminum.

9. The drawer head of claim 4 in which said securement means comprises a generally U-shaped member extending from the bottom edge of said handle plate and including first and second depending legs for receiving the top edge of the back plate therebetween.

10. The drawer head of claim 9 in which one of said first and second legs includes two raised shoulders and the other of said first and second depending legs includes a single shoulder positioned generally at a mid-point between said two shoulders of said one leg, whereby, said first and second shoulders and said single shoulder restrain said back plate from moving in directions perpendicular to said handle plate when said top edge of said back plate is inserted into said U-shaped member.

11. The drawer head of claim 9 in which said bottom edge of said back plate is received within said second flange of said front panel, whereby said front panel holds said back plate in a position with said top edge of said back plate received in said U-shaped member.

12. The drawer head of claim 9 in which said handle plate is made of extruded aluminum.

13. A drawer body and a drawer head combination comprising;

a drawer body having a bottom panel, a vertical back panel, a vertical front panel, and a pair of vertical side panels extending between said front and back panels, said front panel of said drawer body including a header flange having a shoulder portion which extends perpendicularly outward from said front panel; and a drawer head in contiguous relationship with said front panel of said drawer body, said drawer head including an arcuate handle extending outwardly from a top end of said drawer head and an elongated slot extending substantially a distance between said vertical side panels of said drawer body adjacent to said handle, said header flange of said drawer body extending through said slot of said drawer head so that said shoulder of said header flange engages said slot and supports said drawer head.

14. The combination of claim 13 in which said drawer head comprises a back plate and a handle plate disposed in coplanar relation and a front panel having a first flange connected to said handle plate and a second flange engaging said back plate for securing said back plate, said handle plate, and said front panel together.

15. The combination of claim 14 in which securement means are provided between a bottom edge of said handle plate and top edge of said back plate for securing said bottom edge of said handle plate to said top edge of said back plate.

16. The combination of claim 15 in which said securement means comprises a generally U-shaped member extending from the bottom edge of handle plate and including first and second depending legs which receive the top edge of the back plate therebetween.

17. The combination of claim 16 in which one of said first and second legs includes two raised shoulders and the other of said first and second depending legs includes a single shoulder positioned generally at a mid-point between said two shoulders of said one leg, whereby, said first and second shoulders and said single shoulder restrain said back plate from moving in directions perpendicular to said handle plate when said top edge of said back plate is inserted into said U-shaped member.

18. The combination of claim 16 in which said bottom edge of said back plate is received within said second flange of said front panel, whereby said front panel holds said back plate in a position with said top edge of said back plate received within said U-shaped member.

19. The combination of claim 13 in which said front panel of said drawer body includes a pair of extended tabs which define apertures, and a pair of fasteners extend through said apertures of said tabs and into said drawer head for securing said drawer head to said drawer body.

20. The combination of claim 13 in which said back plate and front panel define a chamber therebetween and said chamber is filled with foam.

21. The combination of claim 13 in which said header flange includes a perpendicular wall extending upwardly from said shoulder and a lead flange extending perpendicularly outward from said perpendicular wall.

22. The combination of claim 21 in which said perpendicular wall is in a contiguous relationship with said handle plate.

23. The combination of claim 13 in which said handle extends outwardly over said elongated slot of said handle plate and includes a distal end which projects below said elongated slot and shields said header flange from view.

24. A drawer head comprising:

back plate having a bottom edge, top edge and first and second sides;

handle plate having a bottom edge secured to the top edge of the back plate, a pair of sides extending generally parallel to the first and second sides of said back plate, and a top edge which includes an arcuate handle which extends outwardly towards the bottom edge of said handle plate, said handle plate further including an elongated slot which extends substantially between said pair of side edges of said handle plate and is adapted to receive a header flange of a drawer body;

securement means for securing said bottom edge of said handle plate to said top edge of said back plate, said securement means comprising a generally U-shaped member extending from the bottom edge of said handle plate and including first and second depending legs for receiving the top edge of the back plate therebetween;

a front panel having a bottom edge, a top edge, a pair of opposite sides, and first and second flanges extending from said top edge and said bottom edge, respectively, in directions parallel to said back plate, said first flange being positioned adjacent to said bottom edge of said handle plate and said second flange being positioned over said bottom edge of the back plate; and fastening means for securing said first flange of said front panel to said handle plate.

25. The drawer head of claim 24 in which one of said first and second legs includes two raised shoulders and the other of said first and second depending legs includes a single shoulder positioned generally at a mid-point between two said shoulders of said one leg, whereby, said first and second shoulders and said single shoulder restrain said back plate from moving in directions perpendicular to said handle plate when said top edge of said back plate is inserted into said U-shaped member.

26. The drawer head of claim 24 in which said bottom edge of said back plate is received within said second flange of said front panel, whereby said front panel holds said back plate in a position with said top edge of said back plate received in said U-shaped member.

27. A drawer body and drawer head combination comprising:

drawer body having a bottom panel, a vertical back panel, a vertical front panel, and a pair or vertical side panels extending between said front and back panels, said front panel of said drawer body including a header flange having a shoulder portion which extends perpendicularly outward from said front panel and said front panel further including a pair of extended tabs which define apertures, and a pair of fasteners extend through said apertures of said tabs and into said drawer head for securing said drawer head to said drawer body; and a drawer head in contiguous relationship with said front panel of said drawer body, said drawer head including an arcuate handle extending outwardly from a top end of said drawer head and an elongated slot extending substantially along the length of said drawer head adjacent to said handle, said header flange of said drawer body extending through said slot of said drawer head so that said shoulder of said header flange engages said slot and supports said drawer head.

28. A drawer body and drawer head combination comprising:

drawer body having a bottom panel, a vertical back panel, a vertical front panel, and a pair or vertical side panels extending between said front and back panels, said front panel of said drawer body including a header flange having a shoulder portion which extends perpendicularly outward from said front panel; and a drawer head in contiguous relationship with said front panel of said drawer body, said drawer head including an arcuate handle extending outwardly from a top end of said drawer head and an elongated slot extending substantially along the length of said drawer head adjacent to said handle, said header flange of said drawer body extending through said slot of said drawer head so that said shoulder of said header flange engages said slot and supports said drawer head, said drawer head further including a back plate and a handle plate positioned in the same plane and a front panel having a first flange connected to said handle plate and second flange engaging said back plate for securing said back plate, handle plate, and front panel together, and wherein securement means comprising a generally U-shaped member extending from the bottom edge of handle plate and including first and second depending legs which receive the top edge of the back plate therebetween are provided between a bottom edge of said handle plate and top edge of said back plate for securing said bottom edge of said handle plate to said top edge of said back plate.

29. The combination of claim 28 in which one of said first and second legs includes two raised shoulders and the other of said first and second depending legs includes a single shoulder positioned generally at a mid-point between said two shoulders of said one leg, whereby, said first and second shoulders and said single shoulder restrain said back plate from moving in directions perpendicular to said handle plate when said top edge of said back plate is inserted into said U-shaped member.

30. The combination of claim 28 in which said bottom edge of said back plate is received within said second flange of said front panel, whereby said front panel holds said back plate in a position with said top edge of said back plate received within said U-shaped member.

* * * * *